US011376460B2

(12) United States Patent
McCrea

(10) Patent No.: US 11,376,460 B2
(45) Date of Patent: Jul. 5, 2022

(54) SALMON LADDER TRAINING DEVICE

(71) Applicant: JMC Engineering, LLC, San Carlos, CA (US)

(72) Inventor: James Anthony McCrea, San Carlos, CA (US)

( * ) Notice: Subject to any disclaimer, the term of this patent is extended or adjusted under 35 U.S.C. 154(b) by 19 days.

(21) Appl. No.: 17/098,384

(22) Filed: Nov. 15, 2020

(65) Prior Publication Data

US 2022/0152446 A1 May 19, 2022

(51) Int. Cl.

| | |
|---|---|
| ***A63B 1/00*** | (2006.01) |
| ***A63B 21/012*** | (2006.01) |
| ***A63B 21/00*** | (2006.01) |
| ***A63B 21/068*** | (2006.01) |
| ***A63B 23/035*** | (2006.01) |
| ***A63B 23/12*** | (2006.01) |
| ***A63B 22/00*** | (2006.01) |
| *A63B 21/16* | (2006.01) |

(52) U.S. Cl.

CPC ..... *A63B 1/00* (2013.01); *A63B 21/012* (2013.01); *A63B 21/4049* (2015.10); *A63B 22/0005* (2015.10); *A63B 23/03525* (2013.01); *A63B 23/1209* (2013.01); *A63B 21/068* (2013.01); *A63B 21/169* (2015.10); *A63B 21/4035* (2015.10); *A63B 23/1218* (2013.01); *A63B 2022/0035* (2013.01)

(58) Field of Classification Search

CPC ..... A63B 1/00; A63B 21/012; A63B 21/4049; A63B 21/068; A63B 21/169; A63B 21/4035; A63B 22/0005; A63B 22/04; A63B 2022/0035; A63B 23/03525; A63B 23/1209; A63B 23/1218; A63B 9/00; A63B 2009/006

See application file for complete search history.

(56) References Cited

U.S. PATENT DOCUMENTS

| | | | | | |
|---|---|---|---|---|---|
| 4,355,633 | A | * | 10/1982 | Heilbrun | A61H 1/0214 482/903 |
| 4,611,807 | A | * | 9/1986 | Castillo | A63B 22/0005 482/119 |
| 4,822,029 | A | * | 4/1989 | Sarno | A63B 22/0023 482/52 |
| 4,902,002 | A | * | 2/1990 | Huang | A63B 22/0005 482/62 |
| 5,062,633 | A | * | 11/1991 | Engel | A63B 21/4035 482/118 |
| 5,112,043 | A | * | 5/1992 | Gilfillian, Jr. | A63B 22/0023 482/37 |
| 5,145,472 | A | * | 9/1992 | Johnson, III | A63B 21/4049 482/37 |

(Continued)

*Primary Examiner* — Garrett K Atkinson
*Assistant Examiner* — Kathleen M Fisk
(74) *Attorney, Agent, or Firm* — The Kline Law Firm

(57) ABSTRACT

This disclosure addresses an exercise device adapted to enable the user to perform a salmon ladder exercise. The ladder includes a frame with at least one pair of support protrusions that receive an exercise bar. A bearing surface that receives the shaft of a catch array rotatably mounted in the frame. The device further includes a braking mechanism that applies a variable suppression force to the catch array shaft, the variable suppression adjusting the force required to rotate the catch array shaft in the bearing surface.

10 Claims, 12 Drawing Sheets

(56) References Cited

U.S. PATENT DOCUMENTS

| | | | | |
|---|---|---|---|---|
| 5,145,475 | A * | 9/1992 | Cares | A63B 21/157 482/52 |
| 5,496,234 | A * | 3/1996 | Sussich | A63B 7/04 482/37 |
| 6,503,174 | B2 * | 1/2003 | Mantooth | A63B 23/03541 482/37 |
| 7,118,517 | B1 * | 10/2006 | Hale | A63B 21/4015 482/907 |
| 9,017,224 | B1 * | 4/2015 | Singley | A63B 22/0005 482/52 |
| 9,044,630 | B1 * | 6/2015 | Lampert | A63B 24/00 |
| 9,440,132 | B2 * | 9/2016 | Brewer | A63B 22/0023 |
| 10,004,933 | B2 * | 6/2018 | Lennox | A63B 1/00 |
| 11,083,932 | B2 * | 8/2021 | Hilburn, III | A63B 22/0005 |
| 11,154,739 | B2 * | 10/2021 | Kistner | A63B 21/4034 |
| 2002/0091041 | A1 * | 7/2002 | Mantooth | A63B 21/4035 482/35 |
| 2009/0156377 | A1 * | 6/2009 | Brown | A63B 23/1218 482/110 |
| 2017/0252594 | A1 * | 9/2017 | McKenna | A63B 23/1245 |
| 2018/0036573 | A1 * | 2/2018 | Lennox | A63B 21/22 |
| 2020/0171350 | A1 * | 6/2020 | Hilburn, III | A63B 21/012 |
| 2020/0197737 | A1 * | 6/2020 | Kistner | A63B 1/005 |

* cited by examiner

SALMON LADDER TRAINING DEVICE

CROSS REFERENCE TO RELATED APPLICATIONS

N/A

FIELD OF THE DISCLOSURE

The present disclosure relates generally to exercise devices, and more particularly is a "salmon ladder" type training device.

SUMMARY

A "salmon ladder" is a training device that evokes similarities to a fish (salmon) ladder installed in a river, the ladder including a series of gates. The salmon leap over the gates in sequence to arrive at their destination. The successive steps on a fitness salmon ladder simulate nature and the act of swimming upstream.

In various embodiments of the present disclosure, the exercise device is adapted to enable the user to perform a salmon ladder exercise. The ladder includes a frame with at least one pair of support protrusions that receive an exercise bar. A bearing surface in the frame receives the shaft of a catch array rotatably mounted in the frame. The device further includes a braking mechanism that applies a variable suppression force to the catch array shaft, the variable suppression force adjusting the force required to rotate the catch array shaft in the bearing surface.

An advantage of the salmon ladder disclosed herein is that the apparatus need not be as high off the ground as compared to current technology salmon ladder, thereby introducing a greater degree of safety for the user. Moreover, the salmon ladder can be readily installed in rooms with standard ceiling heights. Further, the salmon ladder disclosed herein is quite compact as compared to current art devices. In various embodiments of the salmon ladder, the height of successive stations on the device is adjustable.

BRIEF DESCRIPTION OF THE DRAWINGS

The accompanying drawings, wherein like reference numerals refer to identical or functionally similar elements throughout the separate views, together with the detailed description below, illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

The present disclosure is generally directed to exercise devices. In particular, exercise devices of the "salmon ladder" type, wherein a user lifts himself to successive rung positions, are described.

Figure 1:
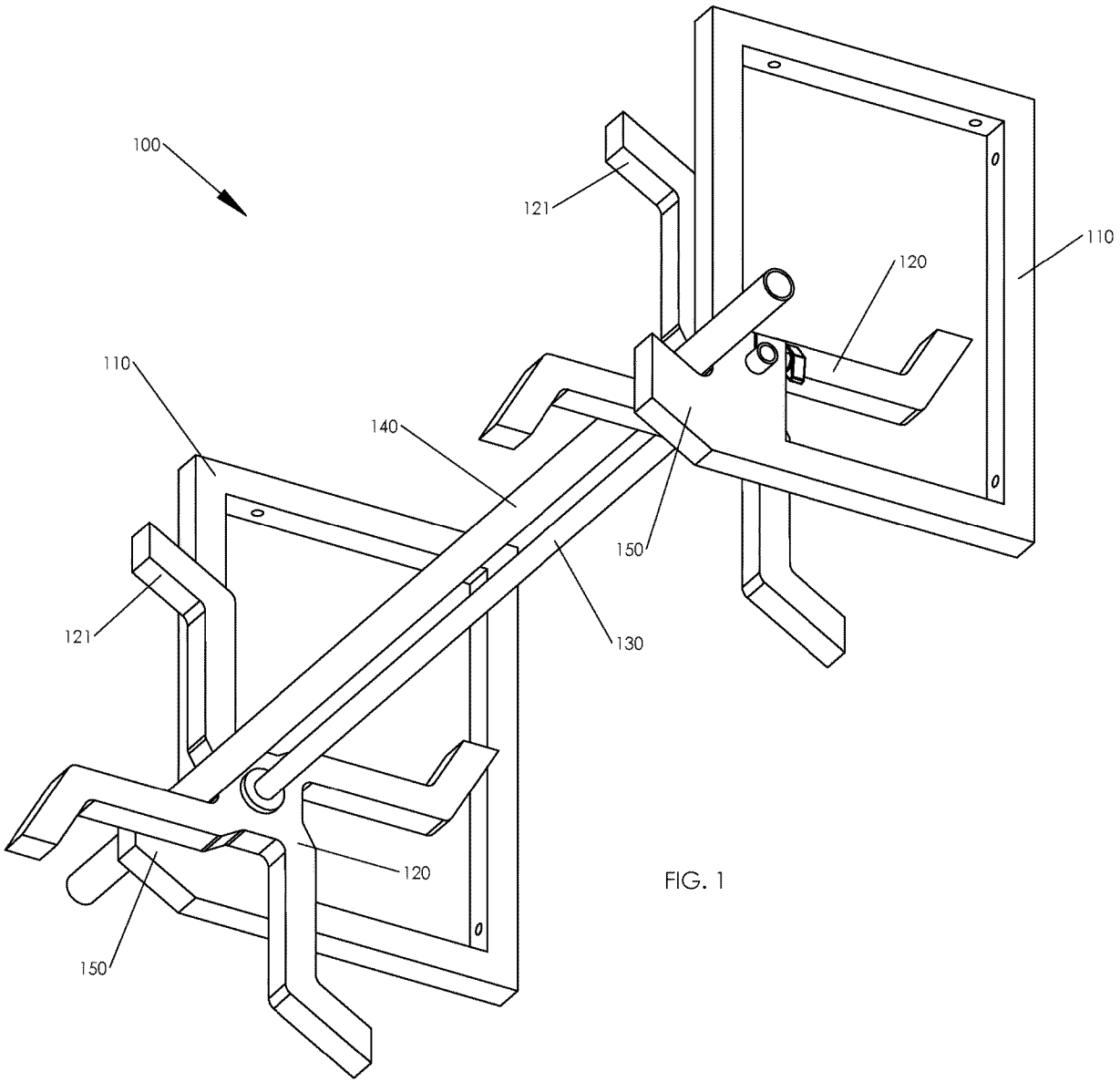
FIG. 1 is a perspective view of a salmon ladder training device according to various embodiments of the present disclosure.

FIG. 1 illustrates a perspective view of a salmon ladder 100. The salmon ladder 100 includes a frame assembly 110 that supports a pair of rotating catch arrays 120. Each catch array 120 includes a plurality of catches 121. The catches 121 may be configured in a generally circular formation on the catch array 120. The catch arrays 120 are affixed and rotate with a shaft 130 mounted in the frame assembly 110.

An exercise bar 140 is received in a pair of support protrusions 150. During exercise, a user lifts himself on the exercise bar 140, then moves the bar 140 to a next successive pair of catches 121. This procedure for an exercise routine will be discussed in greater detail below.

Figure 2:
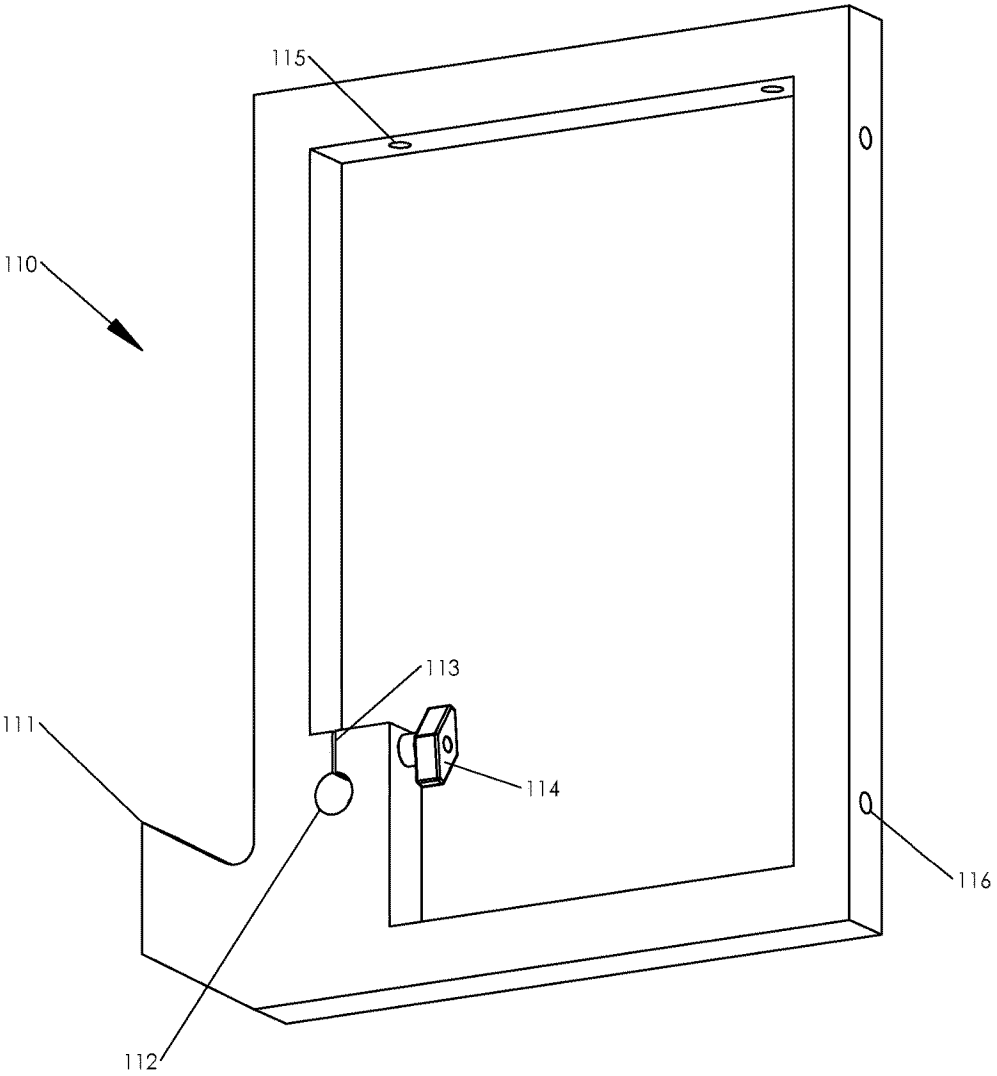
FIG. 2 is a side perspective view showing the frame assembly.

Referring now to FIG. 2, the catch array shaft 130 is received in a bearing surface 112 of the frame assembly 110. The width of an adjustment slot 113 in the frame assembly 110 may be adjusted by a knob 114 or any other suitable compression adjustment mechanism. In this manner, the user can control the friction applied to the shaft 130 as it rotates in the frame 110. In this manner, the rate of rotation of the catch array 120 and thereby the rate of descent of the exercise bar 140 during use can be controlled by the user. It should be noted that a plethora of braking devices could be utilized to vary a suppression force on the catch array shaft 130, thereby varying the force required to rotate the shaft.

Top holes 115 in a top side of the frame assembly 110 allow the user to mount the salmon ladder to a ceiling where the device is being used. Side holes 116 allow the ladder 110 to be secured to a wall.

Figure 3B:
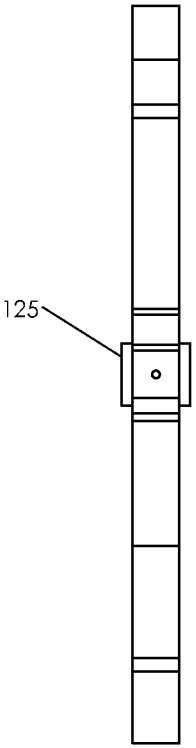
FIGS. 3A and 3B are side and end views of a catch array.
Figure 3A:
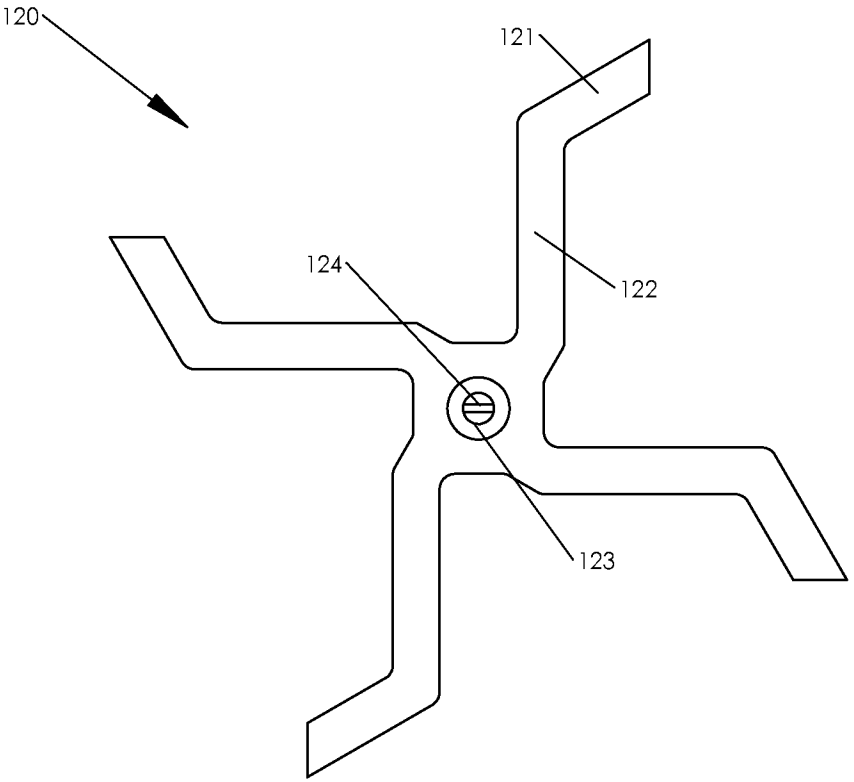

FIGS. 3A and 3B show the catch array 120 in greater detail. The side view of FIG. 3A shows each catch 121 and an associated catch support arm 122. Again, the number of catches 121 on the catch array 120 can be modified as desired by the user. Through hole 123 receives the shaft 130. The shaft 130 is fixed at each end to the catch array 120 by a cross pin 124. The catch array 120 is thereby forced to rotate with the shaft 130 during use. FIG. 3B shows the axial bearing surface 125 of the catch array 120.

Figure 4:
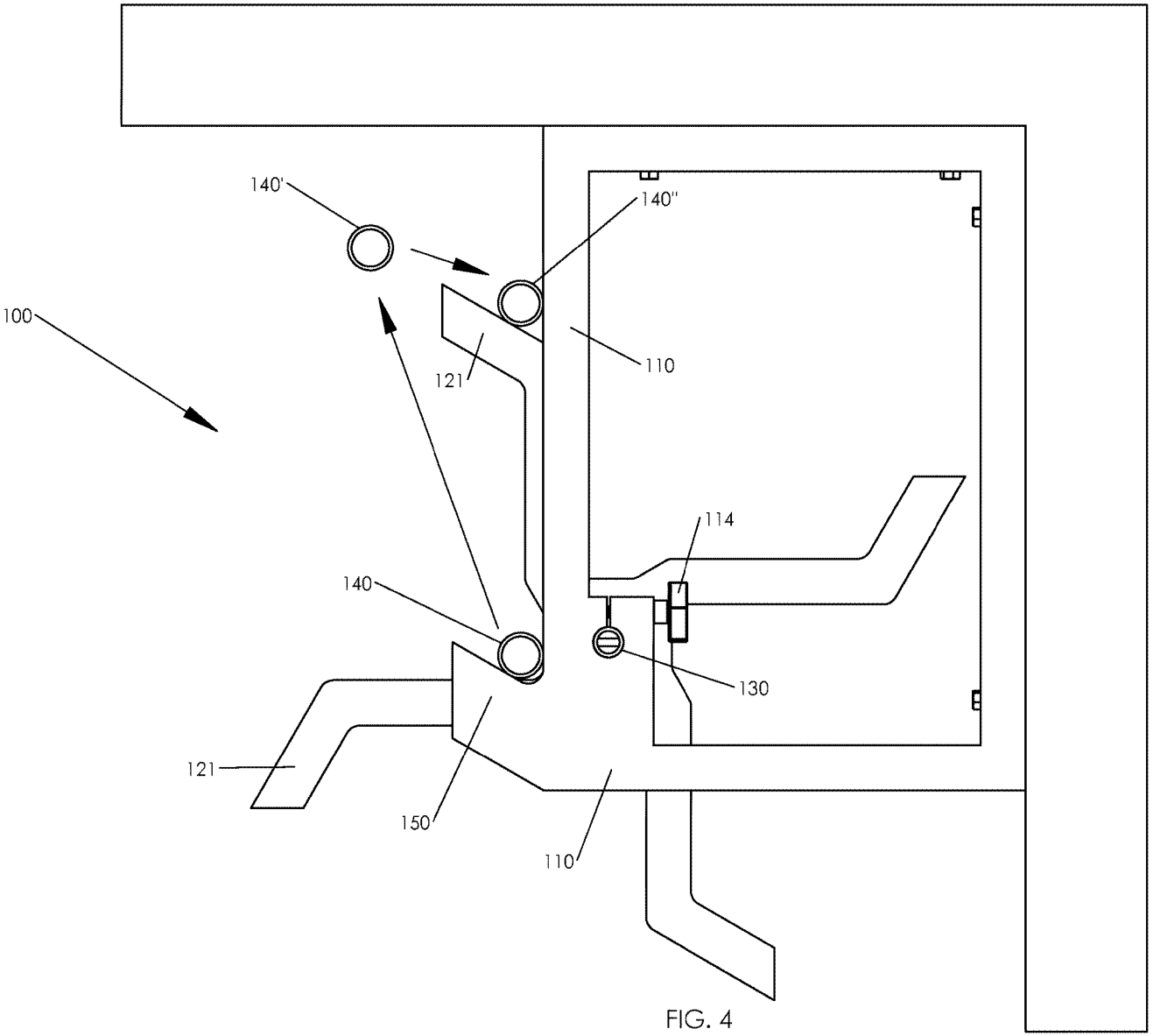
FIG. 4 is a side view of an installed salmon ladder.

FIG. 4 shows the progression of the position of the exercise bar 140 during exercise on the ladder 100. A user begins the exercise with the bar 140 in the resting position on the support protrusions 150 on the frame assembly 110. The user raises himself in a pullup motion via the bar 140, then pushes the bar 140 upward to the position indicated as 140' by leveraging himself off the support protrusions 150. The user then moves the bar 140 forward to the position indicated as 140" so that the bar 140 is resting between one of the catches 121 of the catch array 120 and the support frame 110.

Figure 5:
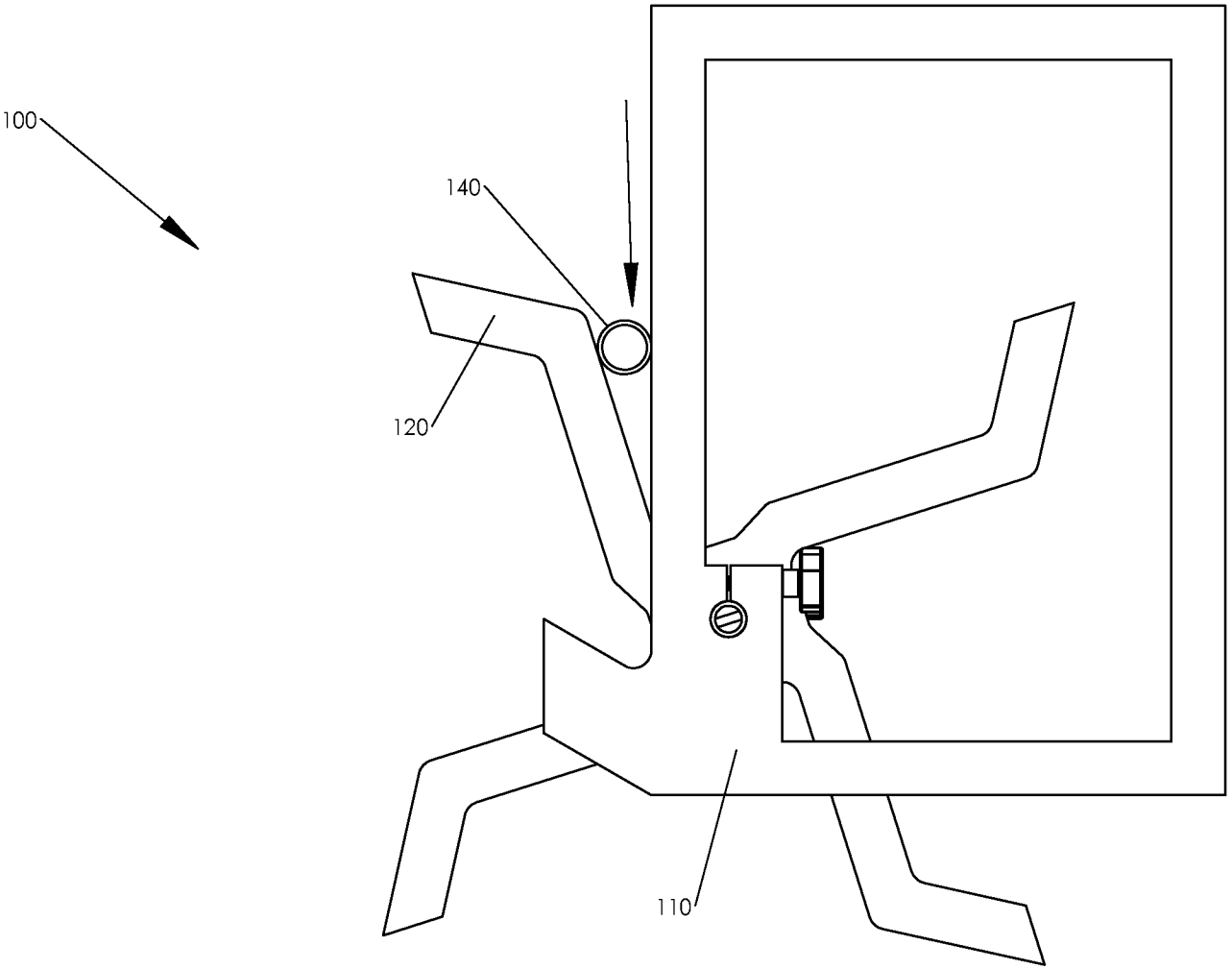
FIG. 5 is side view of the salmon ladder as the catch array is moving to a successive position.

As indicated in FIG. 5, the weight of the user then causes the catch array 120 to rotate so that the bar 140 slides downward, still secured between the catch array 120 and the support frame 110. The user and the bar 140 will descend until the bar 140 is again received in support protrusions 150, which is the end of one repetition. At this point, a successive catch 121 of the catch array 120 will be aligned with its arm 122 parallel to the forward upright member of the support frame 110, in position to catch the next repetition of the lifted exercise bar 140. The user controls the rate of descent by tightening or loosening the knob 114 which varies the pressure on the catch array rotation shaft 130, thereby controlling the rate of rotation.

Figure 6:
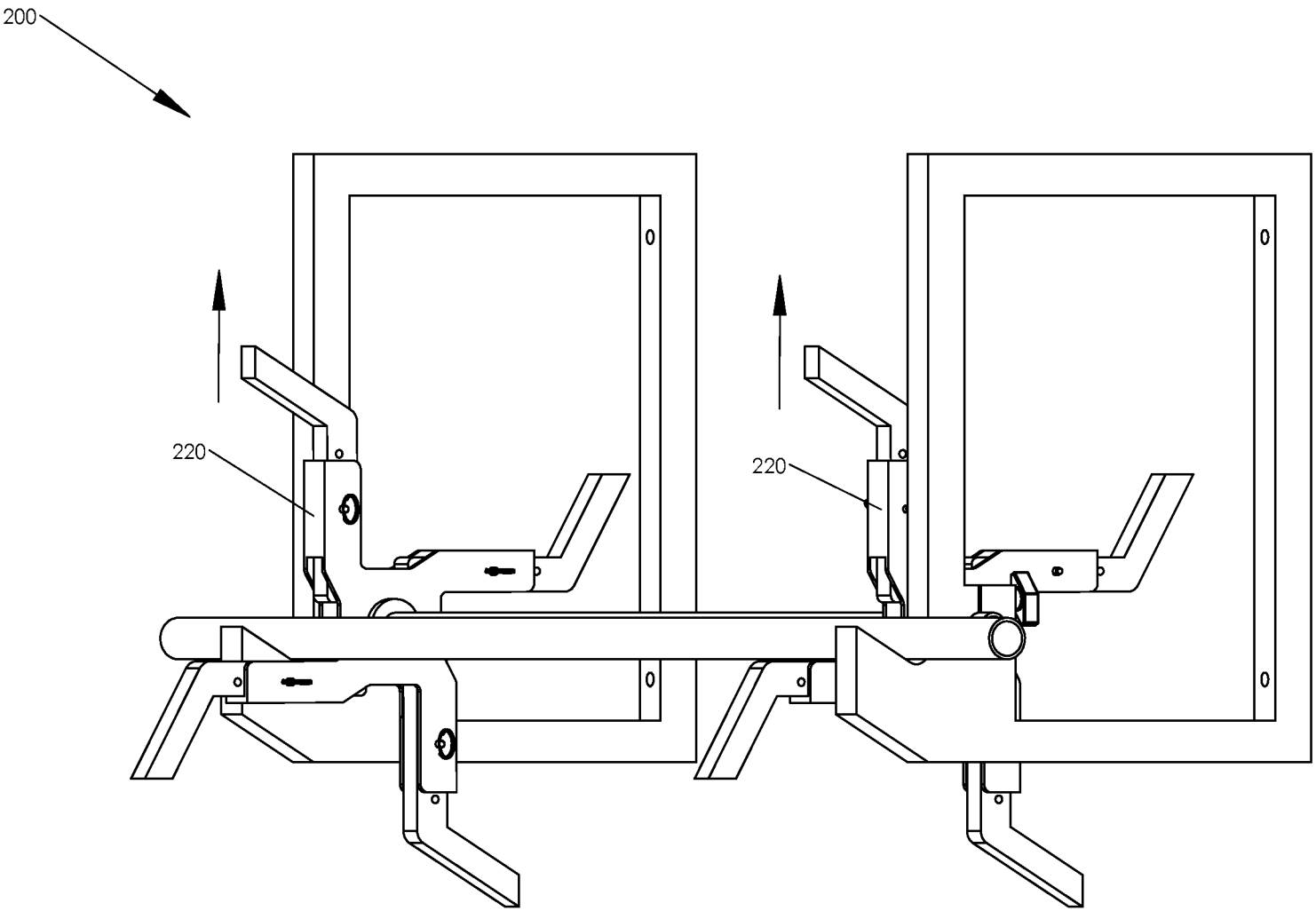
FIG. 6 is a view of a salmon ladder with an adjustable catch array.
Figure 7C:
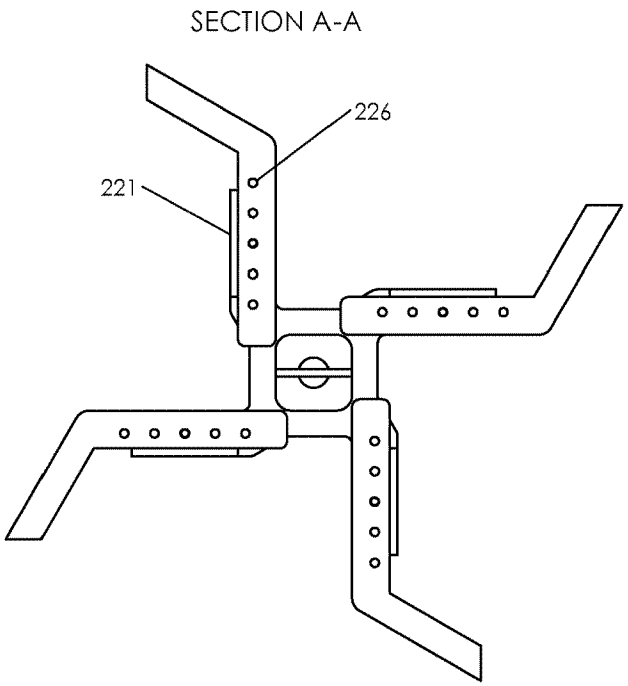
FIG. 7C is a sectional view taken along line A-A in FIG. 7B.
Figure 7B:
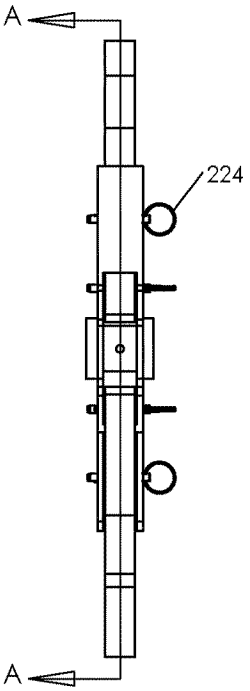
FIG. 7B is an end view of the adjustable catch array.
Figure 7A:
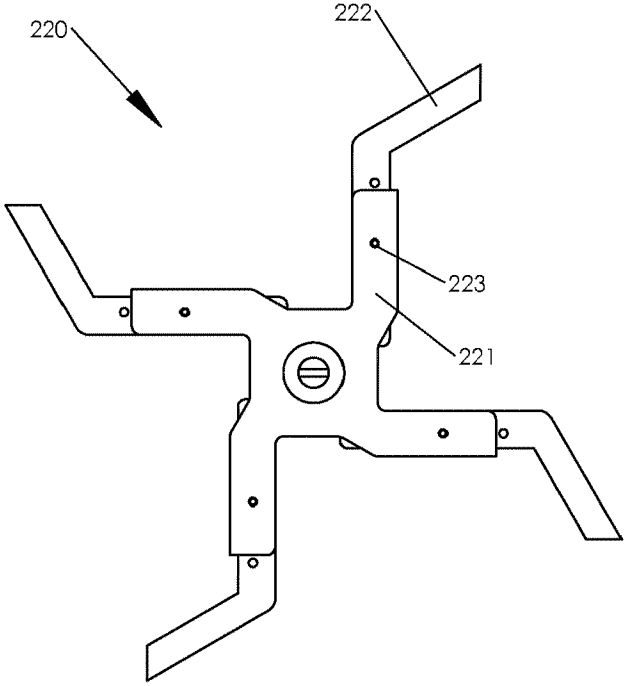
FIG. 7A is a side view of an adjustable catch array.

FIG. 6 illustrates a configuration of the salmon ladder 100 device in which the distance between successive catches on a catch array 220 is variable. Each arm of the catch array 220 includes an adjustment means as illustrated in greater detail in FIGS. 7A-C. Each one of a plurality of catches 222 is received in a catch socket 221. Each catch socket 221 has a securing hole 223 that receives a catch pin 224 to secure the catch 222 in position.

The height of each catch 222 relative to the catch array shaft 130 is controlled by choosing in which one of a series of adjustment holes 226 to align with the securing hole 223. The catch pin 224 is then placed through the securing hole 223 into the selected adjustment hole 226 to fix the catch 222 in place. It should be noted that the length of the catches 222 can be varied within the embodiment. That is, one catch may be 9" in length from the rotation shaft 130, while another could be 10", 11", 12" or any length chosen by the user, and in any increment or order. In this way the successive repetitions performed during exercise can be varied in any order chosen by the user.

Figure 8:
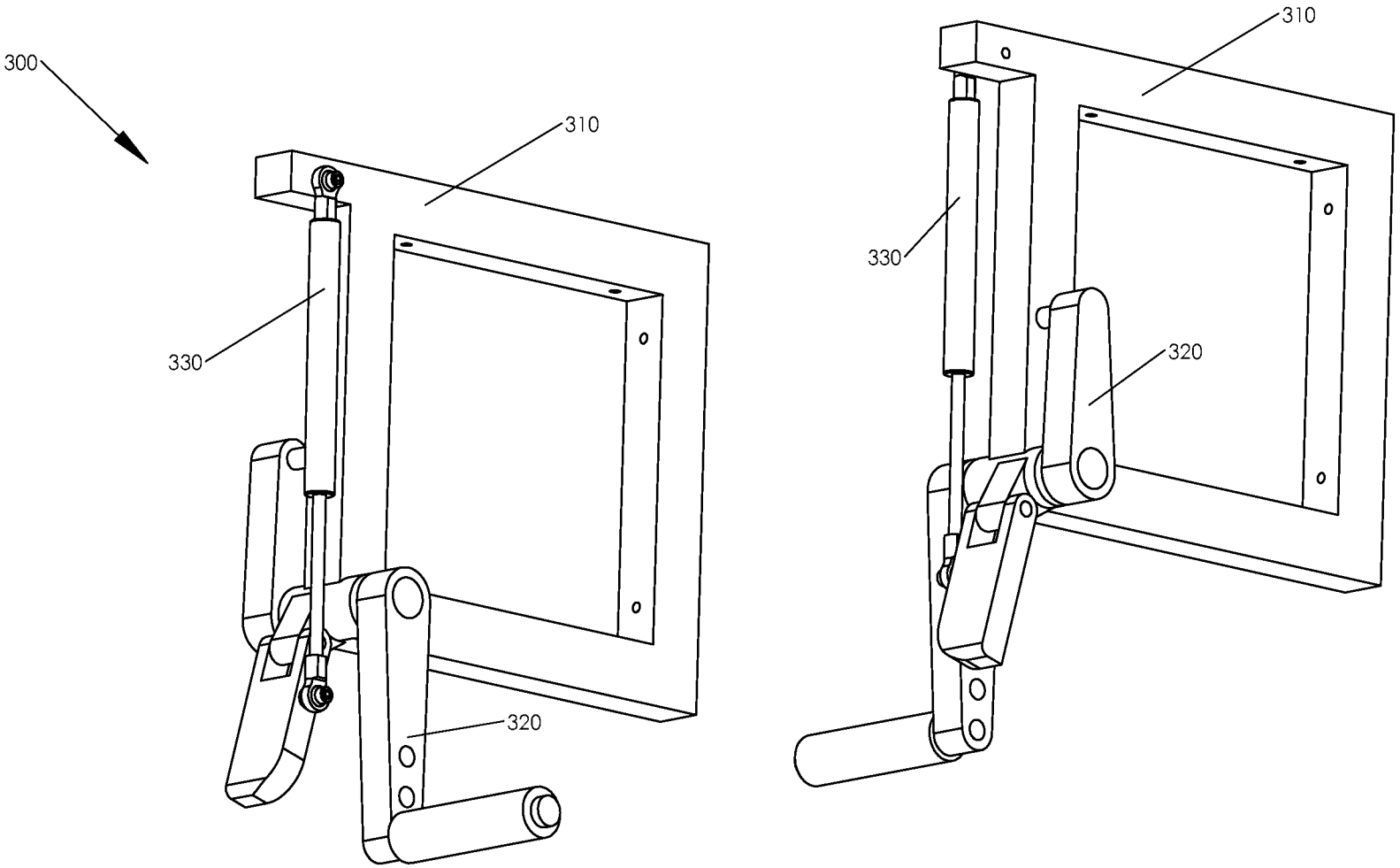
FIG. 8 is a perspective view of an alternate configuration of the salmon ladder.

FIGS. 8-12 show an alternate configuration, a split grip salmon ladder training device 300. In various embodiments of this configuration, the support frame 310 is made with two separate elements as shown in FIG. 8. Each side of the support frame 310 supports a crank assembly 320. The crank assembly 320 is the means by which the user lifts himself during exercise on the split grip ladder 300. A brake 330 slows the descent of the user after he has raised himself via the crank assembly 320.

Figure 9:
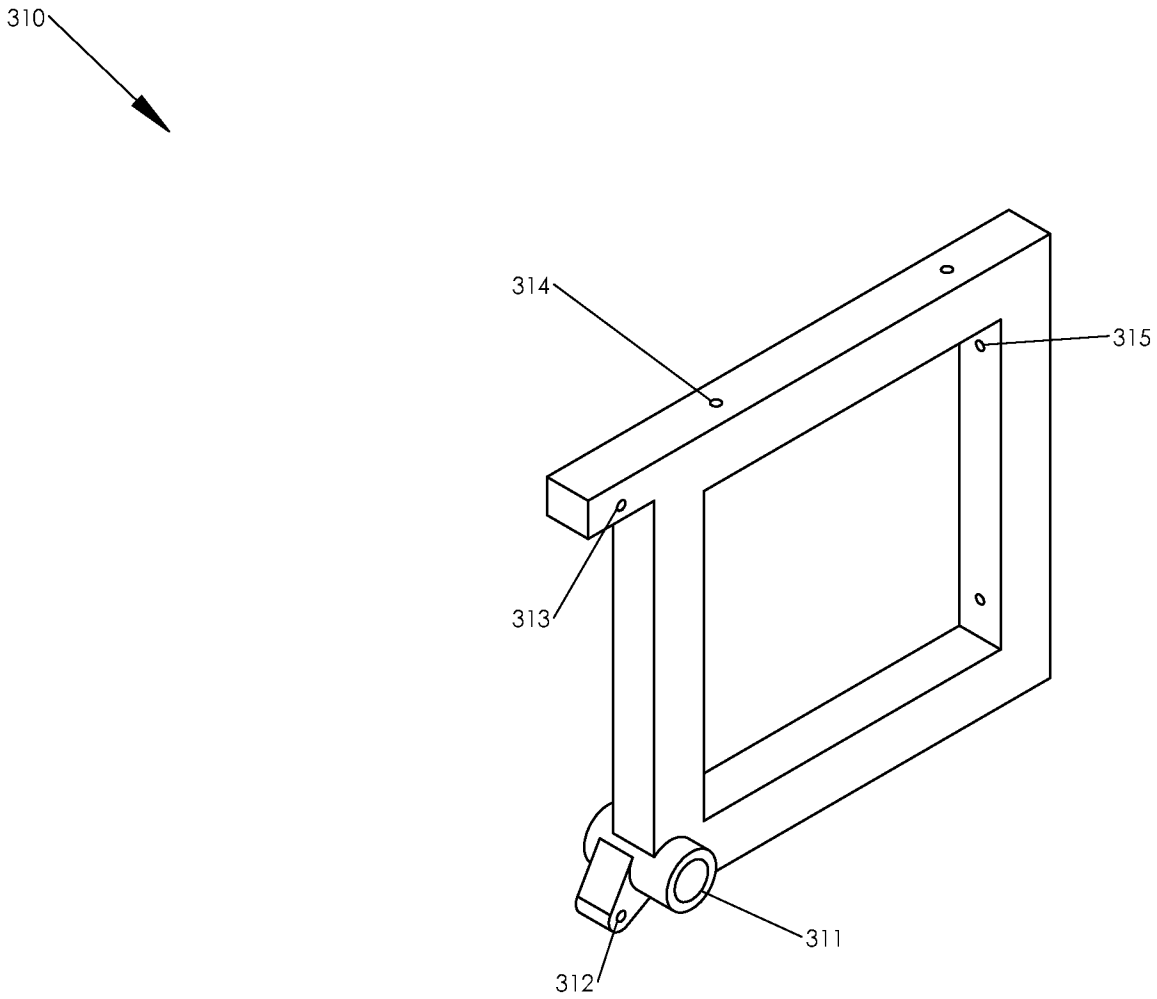
FIG. 9 shows the frame assembly for the configuration illustrated in FIG. 8.

As illustrated in FIG. 9, the frame 310 includes ceiling 314 and wall 315 mounting holes, providing convenient means of attachment of the frame 310 to the wall and/or ceiling of the facility in which the salmon ladder 300 is installed. A brake mount hole 313 provides a convenient first anchor point for each of the brakes 330. The second end of the brake 330 is attached to a brake tab 331 (see FIG. 11) that is mounted on a brake tab bearing surface 312. Shaft mount bearing surfaces 311 receive the rotational axis 321 (see FIG. 10) of the crank assemblies 320.

Figure 10:
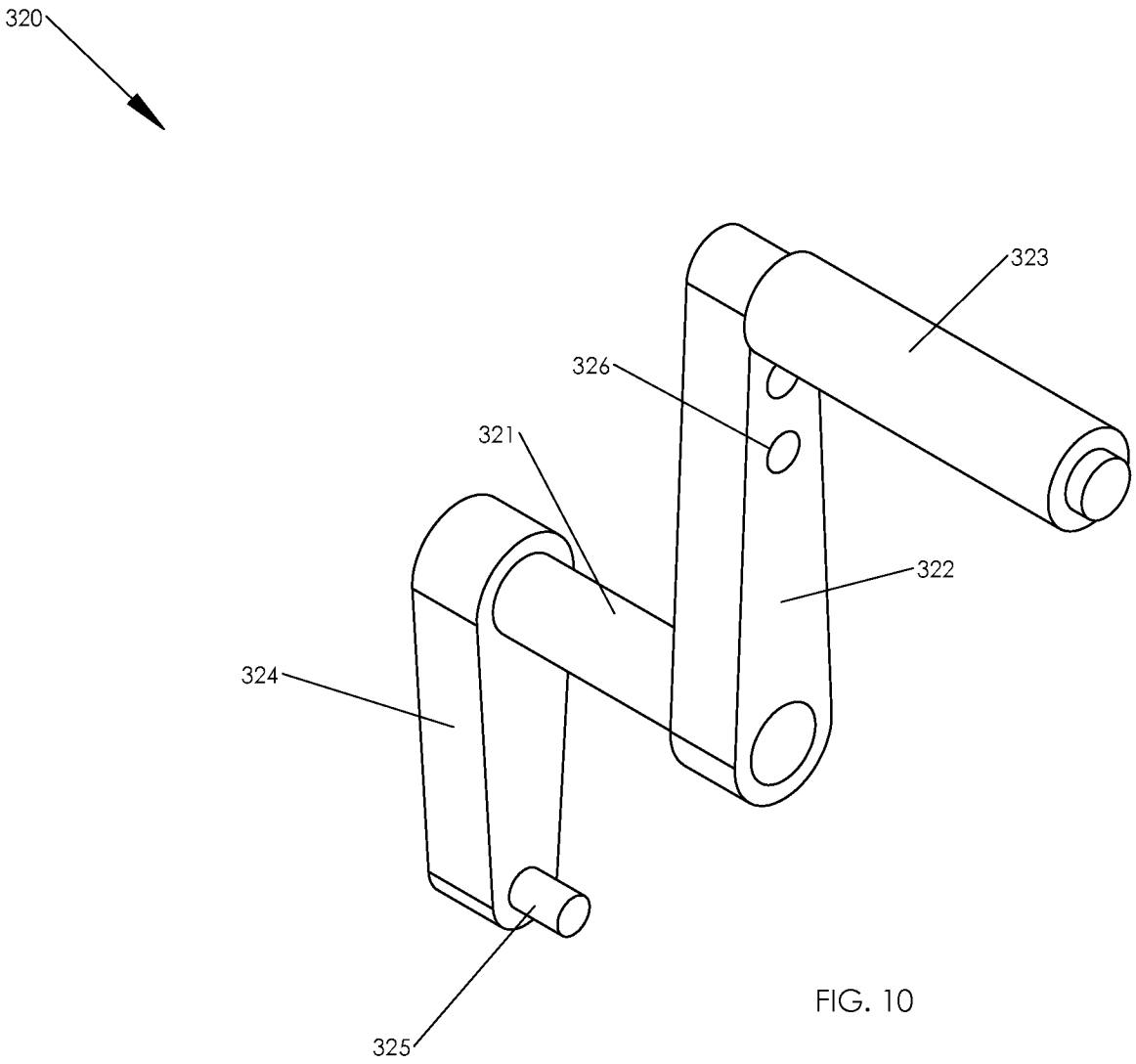
FIG. 10 is a detail view of a crank assembly.

The components of each of the crank assemblies 320 are shown in FIG. 10. The crank is mounted via its rotational axis 321 that is received in the bearing surface 311 of the frame 310. Each crank assembly 320 includes a grip 323. The position of the grip 323 may be varied by mounting the grip 323 in any one of a series of grip mounting holes 326 machined into the crank arm 322. In this manner, the user can determine and vary the travel distance of the grip 323 as it rotates during exercise. A brake arm 324 is mounted on an outer side of the crank assembly, and includes a brake pin 325.

Figure 11:
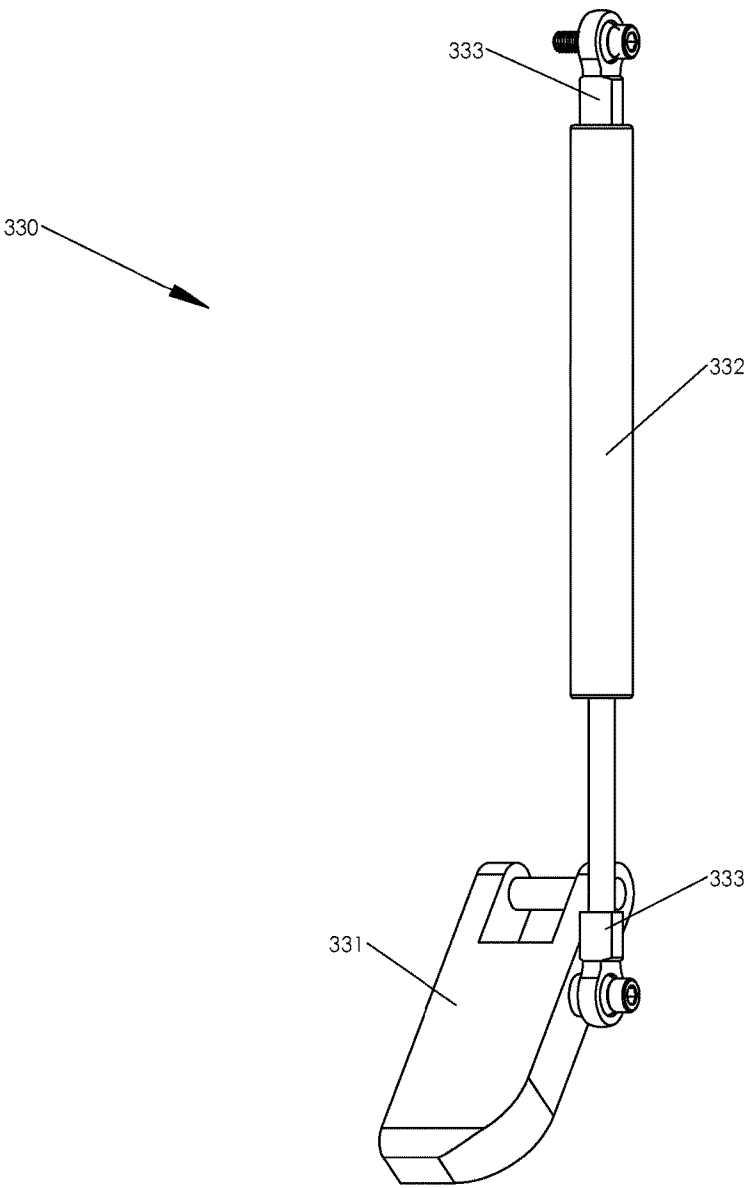
FIG. 11 is a detail view of a brake assembly.

FIG. 11 shows the components of the brakes 330. The brakes 330 include an end fitting 333 at either end to adjustably attach to the salmon ladder 300. The active component of the brake is a gas spring 332. A lower end of the gas spring 332 is affixed to the brake tab 331. The brake tab 331 is mounted so that its axis of rotation is offset from that of the crank assembly 320.

Figure 12B:
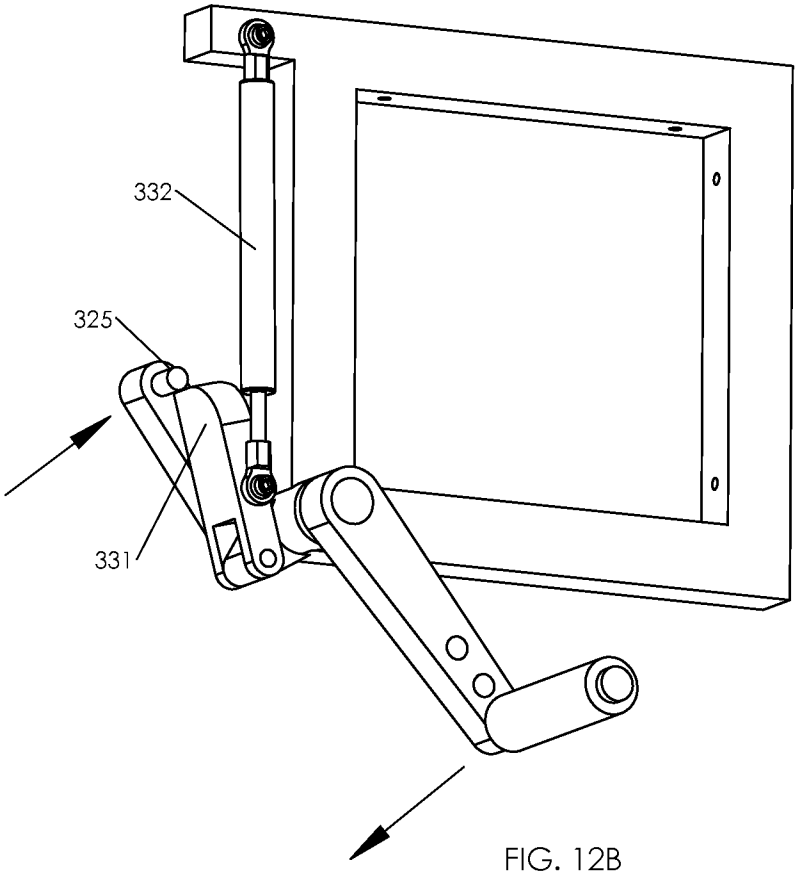
FIG. 12B shows a hand pedal in the position where the brake pin disengages from the brake.
Figure 12A:
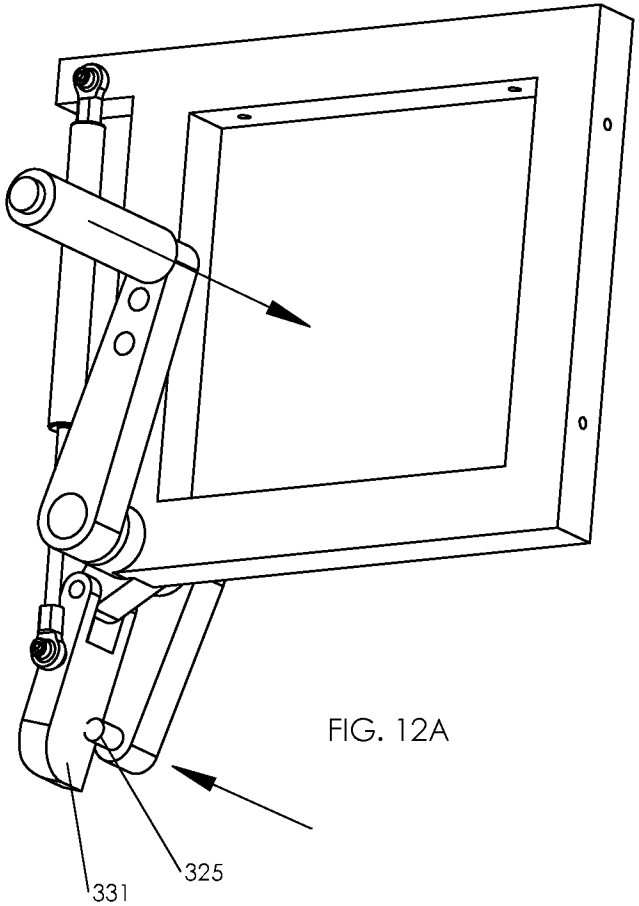
FIG. 12A shows a hand pedal at the point where the brake pin contacts the brake.

Referring now chiefly to FIGS. 12A and 12B, the exercise procedure using the split grip salmon ladder 300 is as follows: During exercise, the user begins a repetition by gripping the handles 323. The user raises himself in a pull up motion as is typical of the salmon ladder exercise. However, it should be noted that with the split grip embodiment 300, the user can raise himself with either both hands or with either hand individually.

As the user begins a repetition, the crank assembly 320 is rotated to a raised position, as shown in FIG. 12A. As the handle 323 passes top dead center, the crank assembly 320 continues to rotate, with the brake 330 slowing the user's descent. The brake pin 325 is in contact with the offset brake tab 331, so that the brake 330 is actuated. As the crank assembly 320 approaches bottom dead center as in FIG. 12B, the end point of a repetition, the brake pin 325 slips over the brake tab 331 so that the brake 330 is released and returns to its non-compressed position (FIG. 12A), ready for another repetition.

The technology disclosed herein addresses improved exercise device configurations. The improvements disclosed are independent of the actual materials used and the sizes of the resultant machines.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

In the foregoing description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. An exercise device comprising:

a frame comprising at least one pair of support protrusions that receive a displaceable exercise bar and a bearing surface that receives a catch array shaft, the catch array shaft being rotatably received in the bearing surface;

a pair of catch arrays mounted on the catch array shaft, each of the catch arrays comprising multiple catches adapted to support the exercise bar and deployed in a generally circular conformation such that the catch arrays rotate about a single rotational axis; and a braking mechanism that applies a suppression force to the catch array shaft; such that the device is configured to allow a user to perform an exercise in which the exercise bar is moved to successive catches of each of the catch arrays.

2. The exercise device of claim 1, wherein:

each catch of each of the catch arrays includes an arm that aligns generally with a vertical member of the frame, each catch thereby forming with the respective vertical member of the frame a receiving area for the exercise bar.

3. The exercise device of claim 2, wherein:

the device is configured such that a weight of the exercise bar and the user urge the arm of a selected one of the catches of each of the catch arrays away from the respective vertical members of the frame so that the exercise bar slides downward between the vertical members and the respective arm of each of the catch arrays.

4. The exercise device of claim 3, wherein:

a rate at which the exercise bar slides downward is controlled by the braking mechanism.

5. The exercise device of claim 1, wherein:

each of the catch arrays rotate so that successive selected ones of the catches are utilized in successive repetitions of an exercise.

6. The exercise device of claim 5, wherein:

each of the catch arrays comprise a length adjustment mechanism that varies the distance from each catch to the catch array shaft.

7. The exercise device of claim 1, wherein:

the braking mechanism is a compression mechanism applied to a slot in the frame.

8. The exercise device of claim 1, wherein:

the suppression force applied by the braking mechanism is a variable force.

9. The exercise device of claim 1, wherein:

each of the catch arrays comprise a length adjustment mechanism that varies the distance from each catch to the catch array shaft.

10. The exercise device of claim 1, wherein:

each of the catches of each of the catch arrays is received in a catch socket, each catch socket having a securing hole that receives a catch pin that passes through one of a series of adjustment holes to secure each respective catch in position.

* * * * *